US007833080B2

(12) United States Patent
Arnaumanresa et al.

(10) Patent No.: US 7,833,080 B2
(45) Date of Patent: Nov. 16, 2010

(54) CONTROL SYSTEM AND METHOD FOR ELECTRIC TOY VEHICLES

(75) Inventors: Luis M. Arnaumanresa, Barcelona (ES); Ignacio Domingo Garcia, Madrid (ES); Rafael Ortiz Ontoria, Madrid (ES); Andrés Lopez Saiz, Madrid (ES)

(73) Assignee: Winkler International, SA, Luxembourg (LU)

( * ) Notice: Subject to any disclaimer, the term of this patent is extended or adjusted under 35 U.S.C. 154(b) by 1332 days.

(21) Appl. No.: 10/532,056

(22) PCT Filed: Oct. 22, 2002

(86) PCT No.: PCT/ES02/00500

§ 371 (c)(1), (2), (4) Date: Nov. 15, 2005

(87) PCT Pub. No.: WO2004/037366

PCT Pub. Date: May 6, 2004

(65) Prior Publication Data

US 2006/0148579 A1 Jul. 6, 2006

(51) Int. Cl.
*A63H 33/00* (2006.01)

(52) U.S. Cl. ..... 446/454; 446/444; 463/63

(58) Field of Classification Search ..... 446/454–455; 463/63; 104/53, 60, 249, 250; *A63H 30/00*
See application file for complete search history.

(56) References Cited

U.S. PATENT DOCUMENTS 4,141,553 A 2/1979 Beny et al. ..... 273/86
6,457,681 B1 * 10/2002 Wolf et al. ..... 246/187 A

FOREIGN PATENT DOCUMENTS

| | | |
|---|---|---|
| EP | 0070933 | 2/1983 |
| EP | 70933 A1 * | 2/1983 |
| EP | 0574634 | 4/1997 |
| EP | 574634 B1 * | 4/1997 |
| EP | 0806230 | 6/2002 |
| ES | 2113312 | 4/1998 |
| ES | 2117517 | 8/1998 |

* cited by examiner

*Primary Examiner*—Peter DungBa Vo
*Assistant Examiner*—Alex F. R. P. Rada, II
(74) *Attorney, Agent, or Firm*—Nixon & Vanderhye, PC

(57) ABSTRACT

The invention relates to a control system and method for electric toy vehicles. The invention is suitable for vehicles which are controlled using a control element, which are actuated by an electric micromotor and which move on tracks comprising a guide groove which is flanked by electronductive tracks. Moreover, each vehicle is provided with a dynamic current collector and guide assembly comprising a guide flange which keeps the vehicle on the track. The inventive system comprises a transmitting control device which is associated with the above-mentioned control element in order to transmit signals in the form of digital waves which control the operation of the vehicle, a control device which receives the aforementioned signals and which is built into the vehicle, and actuation means which are connected to said receiving device. According to the invention, the signals are applied to at least one electronductive track which can be shared temporarily by at least two vehicles equipped with respective receivers.

27 Claims, 5 Drawing Sheets

CONTROL SYSTEM AND METHOD FOR ELECTRIC TOY VEHICLES

This application claims priority to PCT International Application No. PCT/ES2002/000500 filed Oct. 22, 2002, the entire contents of which are hereby incorporated by reference.

FIELD OF THE INVENTION

The present invention refers to a control system for electric toy vehicles specially of the type that move on a track with guide grooves flanked by electroconductive tracks from which they take dynamically electrical current. The invention also concerns to a control method of such vehicles. In the state of art it is well known to remote control the speed of a toy vehicle, which moves by guide means and takes dynamically current from electroconductive tracks associated to these guide means, regulating by means of a variable resistor device the current provided to said electroconductive tracks. A power supply of DC provides a constant maximum voltage to said variable resistor device, which is integrated in a control provided with a pushbutton or trigger to disposition of the user and connected by cable to the electroconductive tracks associated to guide means of a particular vehicle. Generally, the game comprises several vehicles that move by parallel, independent guides, and the voltage provided to each vehicle is controlled by a different player. In this system of the state of the art, the control does not take place on a concrete vehicle but on the electroconductive tracks of the guide by whom it moves. It is not possible, for example, to control independently two vehicles that move by a same guide.

Patent EP-A-0806230 describes to a system of communication by radio between the control and power supply of the electroconductive tracks. Patent ES-A-2113312 describes a system by means of which different voltages are applied to the electroconductive tracks with the purpose of applying different speeds to the toy vehicles starting off from a programmable digital sequence. Patent ES-A-2117517 describes means of control of the speed of the vehicles that are well known in the state of the art but it adds the item that the electroconductive tracks present discontinuities.

Patent EP-A-0574634 describes a control system of a toy vehicle controlled by radio that rolls free (without being guidance by guide groove) to which is sent operative commands, transported by digital control signals that they include an authentication code. This is specially useful when by some reason there are not many radio channels or it is very expensive to create a system of tunable communication and it is necessary to share an only radio channel for more than one vehicle.

Finally, it is possible to emphasize the U.S. Pat. No. 5,311,106 in which a control is described that instead of using a variable resistor and a voltage uses a power signal of square waveform of variable cycle of work on electronic devices appropriated to reduce the heating. In addition it incorporates the facility to insert what denominates "personality module" that is a resistor circuit that can modify the behaviour of the signal so that it adapts to different types of cars.

The objective of the present invention is to contribute a control system and method for electric toy vehicles that move on a track with several guide grooves, each one flanked by electroconductive tracks from which the vehicles take dynamically electrical current, that allow to control independently each vehicle of the guide groove by whom this one moves.

DETAILED DESCRIPTION OF THE INVENTION

The previous objective is reached, in agreement with present invention, applying the use of DS (digital signal) to the control of electric toy vehicles that move on a track with several guide grooves, being each guide flanked by electroconductive tracks from which the vehicles take dynamically electrical current. Said DS include an authentication code of each vehicle not on an only radioelectric radio channel, like in mentioned patent EP-A-0574634, but on the same electroconductive tracks, reason why the use of the authentication code is essential.

The present invention concerns to a control system for electric vehicle of special toy specially of the type that moves on a track with a guide groove flanked by electroconductive tracks with electrical current, as it is well known in the state of the art. Said vehicle includes an electrical micromotor that transmits movement to at least an shaft of the vehicle, constitutive of the drive shaft of the same one, and includes a set of guide and dynamic current collector in the front extremity of the chassis, as it includes an guided fin adapted to slide by the inner part of the mentioned guide groove retaining the vehicle on the track.

As it is conventional, this vehicle is commanded by a control that in the present invention is characterized in that it includes at least a transmitting control system to send signals that manage the operation of the vehicle. Therefore said vehicle includes a receiving control system to receive said signals and actuator means associated to said receiver. In addition, in a preferred embodiment, the vehicle includes a transmitting control system, capable of transmitting signals of information as for example position, crosses or parking in certain points of the circuit or other incidences of the vehicle during its movement by the track. In addition, altogether with this transmitter, electromagnetic and/or mechanical means are arranged that interact with the mentioned transmitter to activate the transmission of the mentioned information to a management and control unit of the information to which said control, that is at least one, is associated.

The present invention also is characterized in that the mentioned signals sent in the first place from the associated transmitter to the control, are digital waveform, and consist of a temporary weft of pulses in series, composed by first pulses that carry of an authentication code of the vehicle, followed by second pulses that carry of an operative command about the operation of the vehicle.

The case of basic operative command transmitted from the station to the vehicle, is without any doubt the one of the control of the speed. This command concerns to the drive of one of the mentioned vehicle means of performance as a system that regulates the power applied to the micromotor and consequently regulates the speed of the same one. It has also been foreseen that in another embodiment, that the controls do not codify the signal. The controls are connected to the station in a concrete port. The station detects the presence of a control and associates to said port a code that later will associate to a concrete vehicle.

The important thing is to distinguish that this operative command is only processed if the receiver associated to the vehicle validates the authentication code.

Secondly, similarly, the present invention also is characterized in which the signals sent from the transmitter associated to the vehicle are of digital waveform composed by first pulses that carry an authentication code foreseen to be compared with a reference code by the station, followed of second pulses that carry of a message as a information about the position, crosses or parking in certain points of the circuit or similar situations or operative conditions of the vehicle. In the same way, said message is only processed if the receiver associated to the station validates the authentication code.

It has been foreseen that the transmission from the vehicle to the station is done in a certain interval of time fixed by said station after authorizing the vehicle the permission for it. Thus, before transmitting, the station makes a polling between the vehicles to ask which wants to transmit. Later the station is put in high impedance to make listening and after processing the answers, it applies a series of criteria to grant the permission to one of them whom after a period of time makes the communication.

The use of this codified communication has the main application that at least one same electroconductive track is susceptible to be temporarily shared by at least two vehicles equipped with respective control devices. This same shared electroconductive track is typically the one destined one to power.

Although in the preferred embodiment the DS are applied on the same electroconductive tracks of transmission of power of the mentioned micromotor, but it has been foreseen the possibility to use an alternative electroconductive track like independent channel of transmission of the mentioned DS. In a preferred embodiment this alternative route is placed in a lower level and in intermediate situation with respect to the two tracks of current collector that flank the guide groove. In addition, it implies the necessity of incorporating in the vehicle an additional dynamic current collector, to be able to take the control signals towards the receiver. In both cases the codified communication allows to share the same track.

It has been foreseen an embodiment where the DS of control are between a first level of voltage of predetermined power and a second level of voltage so that they are superimposed on a power signal to said first predetermined level of voltage, to circulate for the same power electroconductive tracks.

In another embodiment it has been foreseen to multiplex the control signal and the one of power in the time. During a very brief but sufficient period of time denominated tcontrol the described pulses would be transmitted and next it would apply the power signal to the electroconductive tracks.

It has been foreseen the possibility that in case that more than one vehicle moves on the same guide groove would be interesting to provide means so that the vehicle could make a change of guide groove, to make for example an advancement.

Those means will be based on the drive in the vehicle of performance means as an electromagnetic system, applied to move a retractable element that is preferably associated to the guide set, and which is capable of interacting with a track section, suitably designed, so that the change of guide groove is made.

In the context of the present invention, said drive will come directed by a specific operative command, sent from the transmitter associated to the control towards the vehicle.

For many applications it would be interesting to know the position of the vehicle in the circuit. As it has been mentioned already previously, for this purpose there are first means associated to the vehicle and second means associated to the guide groove.

The first means associated to the vehicle are electromagnetic and/or mechanic means capable of detecting the electromagnetic and/or mechanical excitation generated by second means included by different electromagnetic and/or mechanical devices associated to the guide groove.

The first means associated to the vehicle are those that in addition interact with the mentioned transmitter to activate the transmission of the message that contains the position towards the station.

Previously it has been mentioned the possibility of using an alternative electroconductive track like independent channel of transmission of the mentioned DS. It has been foreseen that in addition this alternative route could also collaborate in the obtaining of information such as the position.

A way to do it would be to have this alternative route in a segmented form, since assuming that the means speed of the vehicles is sufficiently high, noncritical points can be defined in which the control can be interrupted by instants of time sufficiently short, so that it is not affected the performance of the game. The position can be approximately obtained based on with one of these segments the vehicle is in contact in a determined instant.

The present invention also foresees the integration of means for storing a registry of the transmitted signals with the purpose of making a later analysis of the races and preparation of game programs.

By means of the system and the method of the present invention, each player controls his particular vehicle and not the guide by which he runs; that is to say, it is possible to control each vehicle independently of the guide groove through this one moves. For example, two or more vehicles can run by a same guide being controlled independently by their respective players, which is not possible with the systems of the state of the art.

BRIEF DESCRIPTION OF THE DRAWINGS

FIG. 8 shows a scheme of a preferred embodiment of the means associated to the vehicle for said aim and FIG. 9 shows a descriptive scheme of a suitably designed track.

Figure 1:
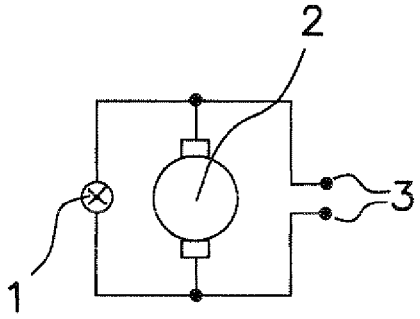
Prior art FIG. 1
FIG. 1 shows an elementary electrical representation of the state of the art with respect to the electric toy vehicle and FIG. 2 does it with respect to the control.

Next a list of references is provided about the figures that could be used in the later concrete embodiment of the invention.

1. Lights

2. Micromotor

3. Dynamic feeding current collector
4. Speed trigger
5. Variable resistor
6. Track connector
7. Authentication code
8. Message (Command or position)
9. Attributes of the message
10. Control signal
11. Power signal
12. Optional dynamic current collector in case of use of an alternative electroconductive track
13. Lights
14. Dynamic feeding current collector
15. Micromotor
16. Control system
17. Electromagnet (change of guide)
18. Speed trigger
19. Optical reader device
20. Control system
20*a*. Code selector
21. Vehicle code switch
22. Light switch
23. Switch of change of guide
24. Track connector
25. Control
26. Control unit
A+I Feeding+information
28. Tracks
29. Vehicle
30. Power supply
31. Other elements of the game: lap counters, speedometer, etc.
32. Indicator of the means speed
33. Indicator of consumption
34. Instantaneous speed indicator
35. Indicator of number of laps
36. Control Pushbuttons
37. Speed trigger
38. Electromagnetic device
39. Guide cover
40. Spring
41. Movable fin
42. Guide groove
43. Deeper zone
44. Pack of power supply of 12 V, insertable
45. Track
46. Six digital control collectors
47. Power supply collector
48. Digital power supply 24 and 12 V
49. Speed trigger
50. Variable resistor
51. Control system
52. Switch of gearshift (turbo)
53. Light switch
54. Switch of change of guide
55. Track connector
56. Authentication code
57. Message (Command or position)
58. Attributes of the message
59. Control signal
60. Power signal

Concrete Embodiment of the Invention

Figure 11:
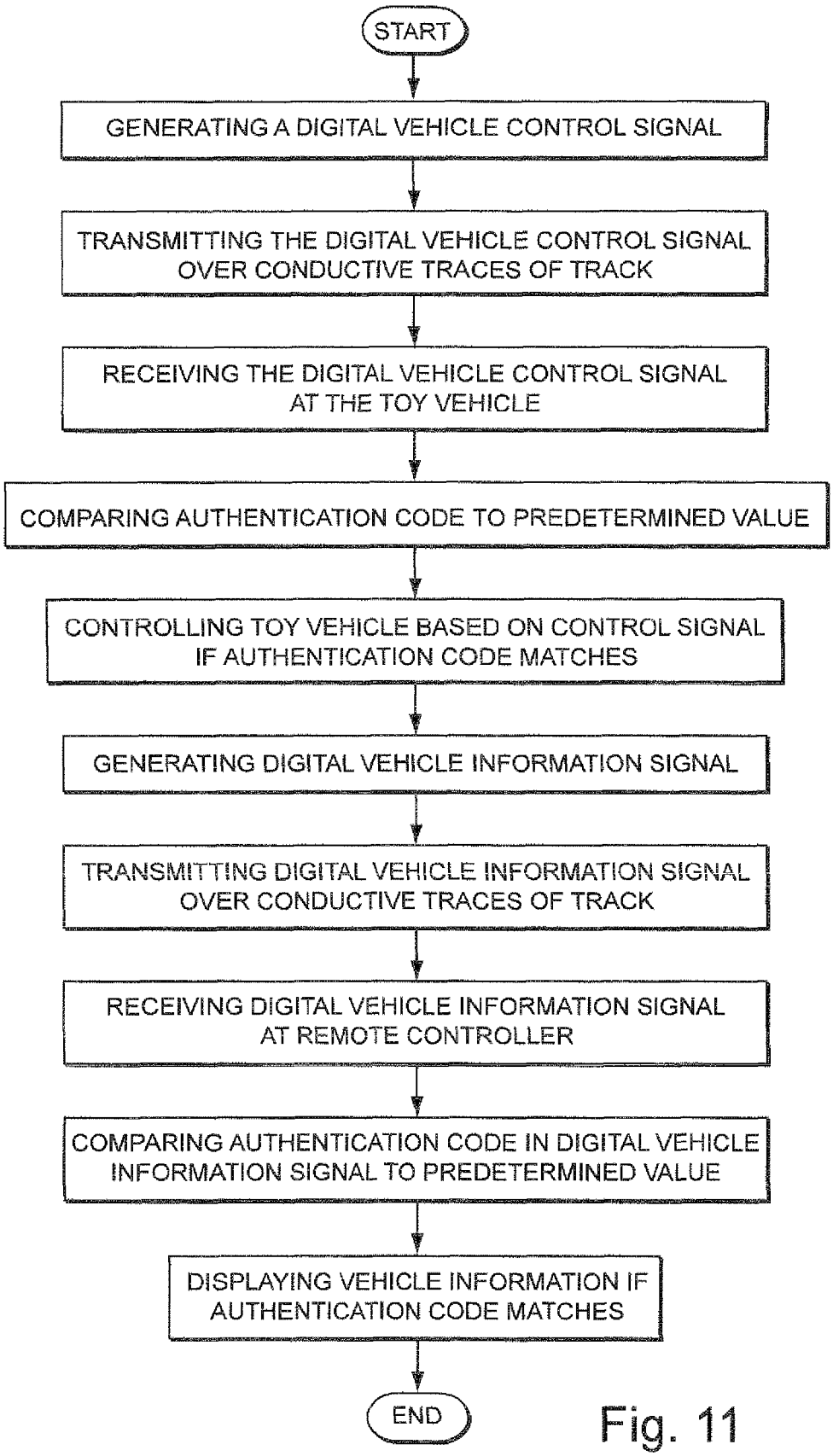
FIG. 11 shows a flow diagram of a method embodying the invention.

FIG. 11 illustrates steps of a method of controlling a to vehicle via a digital vehicle control signal that is applied to at least one electrically conductive trace of a toy vehicle track. This method also includes receiving a digital vehicle information signed at a remote controller and displaying vehicle information on a remote controller. The steps of the method illustrated in FIG. 11 are discussed in greater detail in the following detailed description.

FIG. 1 shows an elementary electrical representation of the state of the art with respect to an electric toy vehicle.

A dynamic feeding current collector 3 feeds micromotor 2 and lights 1 directly, so that they receive more voltage or less voltage as this one is regulated by means of the control. The speed of turn of the micromotor depends directly on the voltage applied on terminals. Therefore, regulating the voltage with the control the speed of vehicle is regulated and with this the speed of the vehicle.

Figure 2:
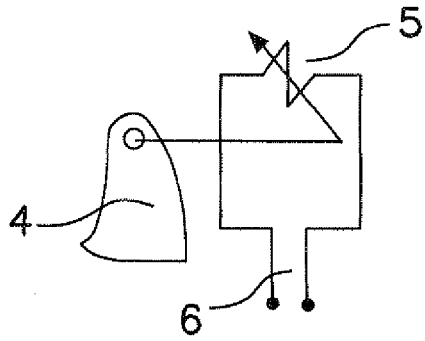
Prior art FIG. 2

FIG. 2 shows an elementary electrical representation of the state of the art with respect to the control.

The speed trigger 4 mechanically regulates the length of a variable resistor 5 applied to a voltage divider so that in the track connector 6 a voltage is had that varies within a certain margin as the trigger 4 varies.

Figure 3:
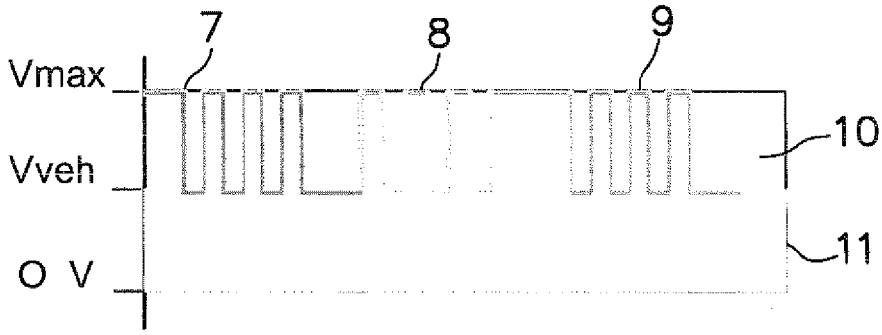
FIG. 3 shows the temporary weft that composes the control signal and its disposition superimposed to the feeding signal.

The control signal, as it is possible to be observed in FIG. 3, is of digital waveform and is formed by pulses in series that carry information, organized in a weft so that it has first pulses that carry an authentication code 7 foreseen to be compared with a reference code by the mentioned receiver. After this code, second pulses 8 are arranged that carry an operative command or message (the position, for example), so that this last one is only processed if the receiver validates the mentioned authentication code. And finally third pulses 9, that carry complementary information, attributes or data in general, being this information associated to the command or the message transmitted in the second pulses 8.

In a first embodiment of the present invention is arranged that this signal is applied on the same electroconductive tracks of feeding by means of the superposition that it has just mentioned. Another embodiment has the multiplexation of the control signal during a brief but sufficient period of time, denominated tcontrol, of about 8 mseg. In that time it would be transmitted the described pulses and next it would apply the power signal to the electroconductive tracks without the motor appreciates the difference.

Both cases are ideal to make compatible the present tracks with the digital system. This compatibility will allow the manufacture of kit of digitalization valid for the old circuits.

Figure 3B:
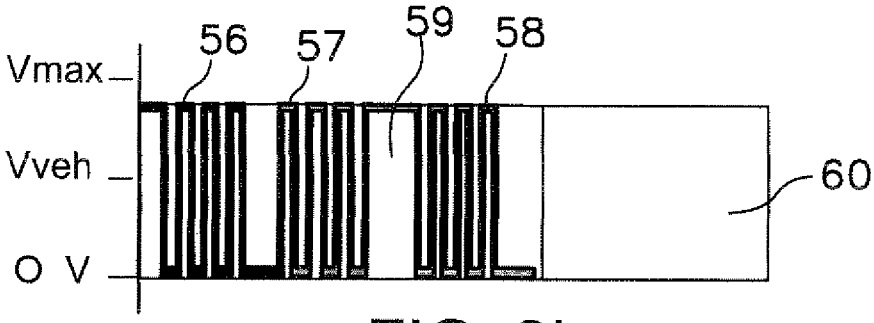
FIG. 3*b* shows the temporary weft that composes the control signal and its multiplexed disposition during the time tcontrol with the feeding signal.

FIG. 3 shows a range of power voltage between 0 V (mass) and a first level of predetermined power voltage Vvehicle (typically of 12 V) and a range of voltage destined to the control signal and comprised between Vvehicle and a second level Vmax voltage (typically of 24 V). The FIG. 3*b* shows the maximum value of the pulses between a Vveh voltage of 18 V and a Vmax voltage of 24 V. The minimum value is of 0 V and power signal is included between Vveh and Vmax.

These levels of voltage are adequated to avoid noise problems and guarantee that there will not be losses in the circuit.

Figure 4:
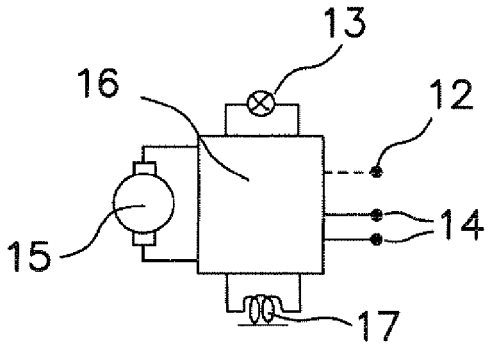
FIG. 4 shows an elementary electrical representation of the present invention with respect to the electric toy vehicle and FIG. 5 does it with respect to the control.
Figure 5:
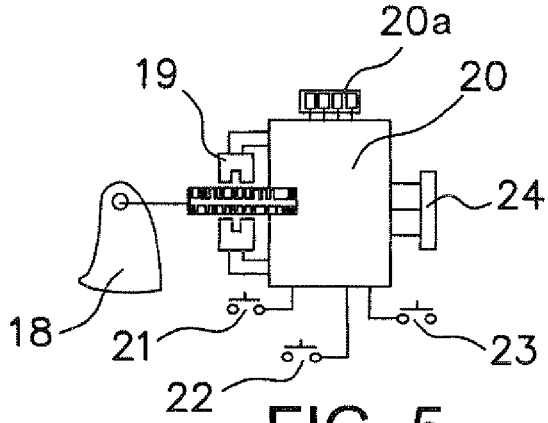
FIG. 5*b* shows an elementary electrical representation of an alternative to the control in that there is not any feeding mechanisms and in that the traditional variable resistor is used.

FIG. 4 shows to an elementary electrical representation of the present invention with respect an toy electric vehicle and FIG. 5 shows it with respect to the control.

FIG. 4 shows to the dynamic feeding current collector 14 and an optional dynamic current collector 12 that corresponds to the use of an alternative electroconductive track, if there were. The novelty with respect to FIG. 1 is the introduction of a control system 16 that makes the functions of receiver of the vehicle. Said device formed by passive components, three transistors and a basic microcomputer. It receives the orders, it decodifies them and it executes them, acting on performance means, as for example electromagnet 17 foreseen for the change of guide. In addition, from the scheme it is deducted that the performance means that regulate the motor speed (that is to say, the voltage applied to its terminals) are integrated within the module corresponding to the control system.

FIG. 5 shows the speed trigger 18 whose movement is detected by means of an optical reader device 19. This device is formed by two optocouplers that make a reading on a plastic sheets of bars associated to the trigger.

From this reading it is obtained the position and the direction of trigger of the control and is processed by the control system 20 that communicates to the vehicle transmitting the signal previously explained.

In addition in the control there is a selector code 20*a*, a switch of code of vehicle 21, switch of lights on/off 22, switch of change of guide 23. All these switches act over the control system 20, that is the most important novelty with respect to FIG. 2 again, so that this suitably communicates the operative command to the vehicles, knowing that only one of them will answer to this command.

The control transmits the authentication code to the vehicle by means of the already mentioned DS, recording this one in its noneraseable internal memory of its processor so that from that moment they form a couple "emitter-receiver". The programming of the code of the vehicle will be made in any section of the track, with the control and the source connected and without no other vehicle in the track, to avoid that two vehicles share the same code.

Figure 5B:
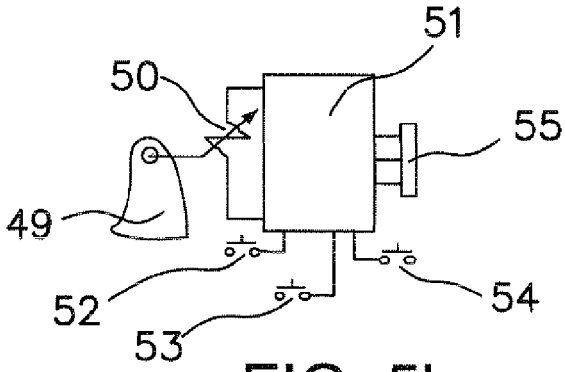

The FIG. 5*b* shows an elementary electrical representation of an alternative to the control in which there are not any signal codification mechanisms and in that the traditional variable resistor 50 is used. In addition switch 52 is a switch of gearshift (turbo). In general, as new functionalities are included, the control will be designed to be incorporating new switches.

The controls are connected to the station in a concrete port. The station detects the presence of a control and associates to said port a code that later will associate to a concrete vehicle.

The stations in that case can have up to four ports and only one of them would connect to the tracks. In order to add more vehicles it is necessary to connect a secondary station to the main one by means of specific connector to extend four more vehicles and so until a maximum of four stations, which would suppose a maximum of 16 vehicles playing.

Figure 6:
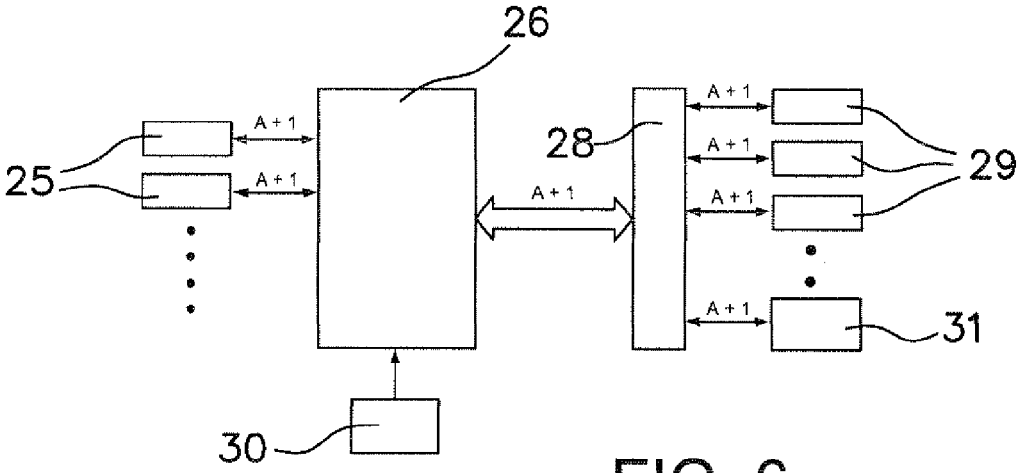
FIG. 6 shows a block diagram of the control system.

FIG. 6 shows a block diagram of the control system. It can be observed how the system allows to be applied parallelly to several vehicles. The key point is the control unit 26. It is remarked that on the same tracks that they feed the vehicles it can be connected other elements of the game 31 how lap counters, speedometer, etc. that will be commented later.

Figure 8:
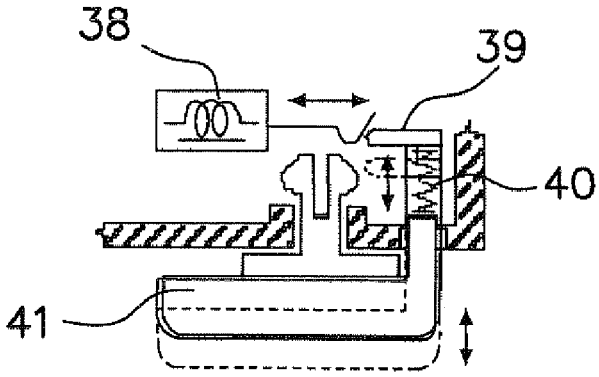
FIGS. 8 and 9 refer to an example of application of the principles of the present invention to a change of guide groove.
Figure 9:
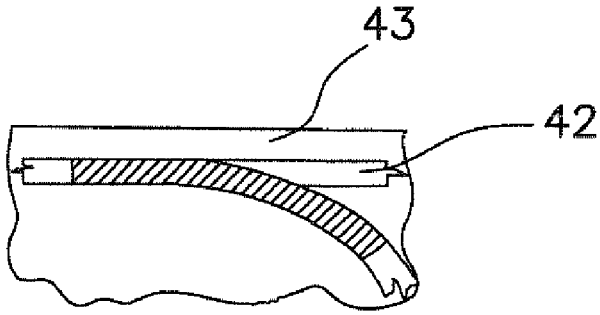

FIG. 8 and FIG. 9 refers to an example of the application of the principles of the present invention to a change of guide groove.

FIG. 8 shows a scheme of an embodiment preferred of the means associated to the vehicle. It is possible to observe that the principle of change of guide is the drive of an electromagnet 38, arranged to move a retractable element associated to the guide set, as movable fin 41, forced by the spring 40, by means of which a change of guide is made in a section of track adequately designed for it, so as it is indicated schematically in FIG. 9. The key is that said fin 41 can sink to make contact with a deeper zone 43 (to prevent that it exists problems in the contacting point between the two guide grooves 42) to force to the vehicle to follow the alternative guide.

Figure 10:
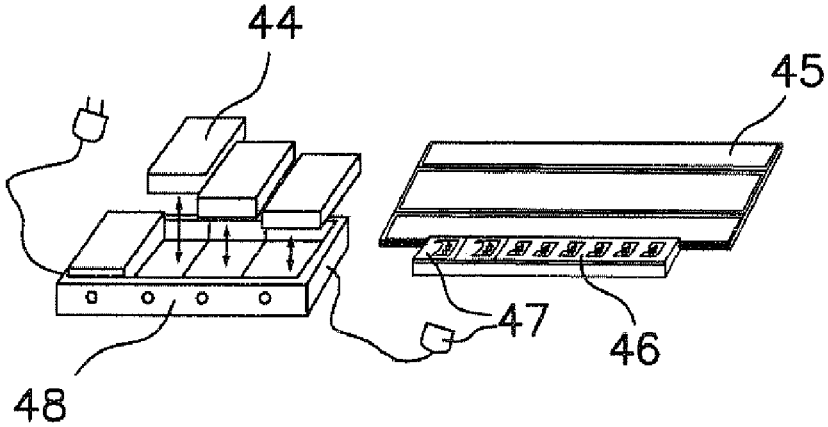
FIG. 10 shows to a scheme of a preferred embodiment for a feeding system and contact system capable of feeding several vehicles in a scalable form.

It is possible to emphasize that the fact to share the same tracks of feeding by different vehicles implies the necessity to cause that the feeding means are scalables according to the final number of vehicles that circulate, for this purpose it has been foreseen the use a new module of feeding like the one shown in the FIG. 10. This is based on a base 48 ("Pack of digital supply") with a common part that it generates +24 V of signalling and +Vvehicle for, for example, 4 simultaneous vehicles, and allows the insertion of up to three more modules 44, than on automatic form, are paralleled over the base pack allowing the growth of the system according to the number of vehicles.

As conclusion is interesting to consider that if to the digital communication differentiated to the feeding it is added the knowledge of the position of the vehicle it is obtained a range of new benefits of simulation of the real competitions, such as any product that depends on a detector of passage by the finishing line like lap counters, speedometers, etc.

If in addition means are provided to store a registry of the transmitted signals it could be done a later analysis of the races and prepare training programs in which the player must overcome his own registries.

Generalizing, thanks to the digitalization will be able to have new concepts in the game, like for example the gregarious vehicles. These are vehicles to which a program with defined orders (speed, change of guide, etc.) has been implemented, that it executes in a sequential and repetitive way, during all the race, becoming during the same one a movable obstacle that will create driving problems and will force to have a special attention during the same one. The type of program to execute can be definable by external form, by means of a specific terminal of programming of said vehicle.

Other concepts will be real trainings with times of classification and position in starting grid, sound reproduction according to real position of the vehicles, pursuit vehicle (Professional Trainer vehicle) and at a more concrete level, on/off lights, push brakes, gearshift, smoke in the skids, reproduction of real sound, entrance in boxes, an advanced control that shows a summary of the parameters of the race, connection to a personal computer to analyze the race with some program adapted for it.

It is foreseen to project also in the future the installation of microcameras inside the vehicles, controls with track vision, races with LCD colour glasses with vision of the position of the pilot in the vehicle, etc.

Figure 7:
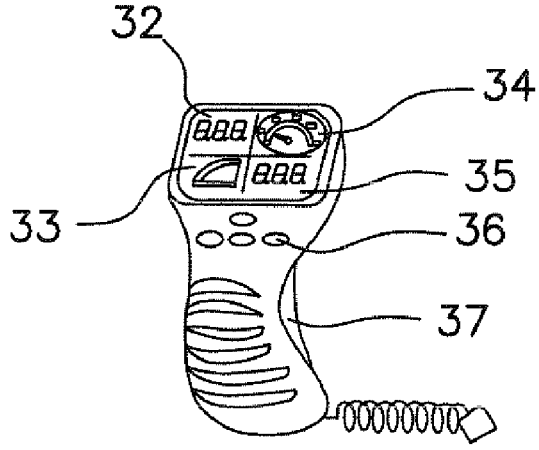
FIG. 7 shows an example of an advanced control with vision and control of functions derived from the knowledge of the position and function of change of guide and other parameters of the vehicle in race.

These new functions will force to develop among other things advanced controls like the one shown in the FIG. 7 that is an example of a digital advanced control with vision and control of functions derived from the knowledge of the position and function of change of guide and other parameters of the vehicle in race.

The invention claimed is:

1. A toy vehicle system, comprising:

a toy vehicle track that includes at least one guide groove to guide movement of a toy vehicle and electrically conductive traces that carry a DC vehicle drive voltage;

a remote controller, comprising:

at least one user actuable element that generates an input signal, a processor that receives the input signal from the at least one user actuable element and that generates a digital vehicle control signal having a digital waveform that includes (1) an address portion identifying a specific toy vehicle and (2) a vehicle operation control portion that contains a command to instruct a toy vehicle to take a particular action, and a transmitter that couples the digital vehicle control signal to the electrically conductive traces of the track, so that the digital vehicle control signals generated by the remote controller are transmitted over the electrically conductive traces of the track; and a toy vehicle that includes:

a guide member that extends down into the guide groove of the track when the vehicle is mounted on the track to guide the vehicle along the track;

electrical pickups that contact the electrically conductive traces on the track;

an electrical motor that drives the toy vehicle along the track; and a vehicle controller coupled to the electrical pickups and the electrical motor, wherein the vehicle controller receives digital vehicle control signals that are transmitted from the remote controller through the at least one electrically conductive trace on the track, wherein the vehicle controller compares an authentication code stored in the address portion of the digital vehicle control signals to a predetermined value, and wherein the vehicle controller acts on the commands contained in the vehicle operation control portion of a digital vehicle control signal when the authentication code stored in the address portion of the digital vehicle control signal matches the predetermined value.

2. The toy vehicle system of claim 1, wherein the at least one user actuable element comprises a vehicle speed control element that produces a speed input signal.

3. The toy vehicle system of claim 2, wherein the vehicle speed control element comprises an optical reader.

4. The toy vehicle system of claim 1, wherein the at least one user actuable element comprises a light switch that produces a light control input signal.

5. The toy vehicle system of claim 1, wherein the at least one user actuable element comprises a steering input device that produces a steering input signal.

6. The toy vehicle system of claim 1, further comprising a vehicle selection switch that allows a user to select which of multiple toy vehicles the remote controller will control and that outputs a vehicle selection signal, wherein the processor receives the vehicle selection signal, and wherein the processor generates digital vehicle control signals that include different values in the address portion depending on the vehicle selection signal received from the vehicle selection switch.

7. The toy vehicle system of claim 1, wherein the vehicle controller selectively applies all or just a portion of the DC vehicle drive voltage received from the electrically conductive traces on the track to the electrical motor in response to digital vehicle control signals received from the remote controller.

8. The toy vehicle system of claim 1, wherein the digital vehicle control signals are superimposed onto the DC vehicle drive voltage.

9. The toy vehicle system of claim 1, wherein the digital vehicle control signals are time division multiplexed with the DC vehicle drive voltage.

10. The toy vehicle system of claim 1, wherein the electrically conductive traces comprise first and second electrically conductive traces that carry the DC vehicle drive voltage, and a third electrically conductive trace that carries the digital vehicle control signals.

11. The toy vehicle system of claim 1, wherein the toy vehicle includes a direction changing element that is switchable between a first position and a second position, wherein the vehicle controller controls the position of the direction changing element based on digital vehicle control signals received from the remote controller.

12. The toy vehicle system of claim 11, wherein the direction changing element is biased into the first position, and wherein the controller moves the direction changing element into the second position in response to digital vehicle control signals received from the remote controller.

13. The toy vehicle system of claim 12, wherein the direction changing element interacts with a direction changing groove of the track, and wherein the track includes direction changing grooves at locations where the guide groove on the track branches.

14. The toy vehicle system of claim 1, wherein the toy vehicle further comprises:

a vehicle information generator that generates digital vehicle information signals having a digital waveform that include (1) an address portion that bears an authentication code that identifies the toy vehicle and (2) a vehicle information portion that includes information about the toy vehicle; and a transmitter that couples the digital vehicle information signals to at least one of the electrically conductive traces of the track.

15. The toy vehicle system of claim 14, wherein the remote controller further comprises a receiver that receives the digital vehicle information signals from the at least one electrically conductive trace of the track, and wherein the remote controller includes a display device that displays information about a vehicle using the information encoded in the received digital vehicle information signals.

16. The toy vehicle system of claim 15, wherein the remote controller includes a vehicle selection switch that allows a user to select which of multiple toy vehicles the remote controller will control, wherein the receiver of the remote controller receives a signal from the vehicle selection switch indicative of the selected vehicle, wherein the receiver compares the authentication code in each digital vehicle information signal to a particular predetermined value that is dependent on the signal received from the vehicle selection switch, and wherein the remote controller only displays information about a vehicle if the authentication code in the digital vehicle information signal matches the particular predetermined value.

17. The toy vehicle system of claim 14, wherein the toy vehicle further comprises a vehicle information pickup module that interacts with the track to determine information about the vehicle, and wherein the vehicle information determined by the vehicle information pickup module is encoded in the vehicle information portion of the digital vehicle information signals.

18. The toy vehicle system of claim 17, wherein the vehicle information determined by the vehicle information pickup module comprises the position of the vehicle along the track.

19. The toy vehicle system of claim 18, wherein the vehicle information pickup module comprises means for sensing at least one marker on the track.

20. The toy vehicle system of claim 18, wherein the vehicle information pickup module comprises means for sensing a plurality of different markers on the track.

21. The toy vehicle system of claim 14, further comprising a recording section that records the digital vehicle control signals generated by the remote controller and the digital vehicle information signals generated by the toy vehicle.

22. The toy vehicle system of claim 1, further comprising a recording section that records the digital vehicle control signals generated by the remote controller.

23. A method of controlling a toy vehicle that includes an electric motor and a digital receiver, the electric toy vehicle being designed to run on a track that includes a groove to guide movement of the toy vehicle and electrically conductive traces that supply electrical power and control signals to the toy vehicle, the method comprising:

generating a digital vehicle control signal having a digital waveform that includes (1) an address portion that includes an authentication code that identifies a specific toy vehicle and (2) a vehicle operation control portion that contains a command to instruct a toy vehicle to take a particular action;

transmitting the digital vehicle control signal over at least one electrically conductive trace of a toy vehicle track;

receiving, at the toy vehicle, the digital vehicle control signal, the toy vehicle receiving the digital vehicle control signal via an electrical pickup that contacts the at least one electrically conductive trace on the track;

comparing the authentication code in the address portion of the digital vehicle control signal to a predetermined value; and controlling an operation of the toy vehicle based on the command in the control portion of the digital vehicle control signal if the authentication code matches the predetermined value.

24. The method of claim 23, wherein the transmitting step comprises superimposing the digital vehicle control signal onto a DC vehicle drive voltage carried on the electrically conductive traces of the track.

25. The method of claim 23, wherein the transmitting step comprises time division multiplexing the digital vehicle control signal with a DC vehicle drive voltage carried on the electrically conductive traces of the track.

26. The method of claim 23, further comprising:

generating a digital vehicle information signal having a digital waveform that includes (1) an address portion that bears an authentication code that identifies the toy vehicle and (2) a vehicle information portion that includes information about the toy vehicle; and transmitting the digital vehicle information signal over at least one of the electrically conductive traces of the track.

27. The method of claim 26, further comprising:

receiving the digital vehicle information signal with a remote controller coupled to the electrically conductive traces of the track;

comparing the authentication code in the digital vehicle information signal to a predetermined value; and displaying information about a vehicle encoded in the digital vehicle information signal on the remote controller if the authentication code matches the predetermined value.

* * * * *